US011148176B2

(12) United States Patent
Nolin et al.

(10) Patent No.: US 11,148,176 B2
(45) Date of Patent: Oct. 19, 2021

(54) POWER SWEEPER

(71) Applicant: TTI (MACAO COMMERCIAL OFFSHORE) LIMITED, Macau (MO)

(72) Inventors: Eric Nolin, Anderson, SC (US); Todd A. Gillespie, Greenville, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 376 days.

(21) Appl. No.: 15/984,463

(22) Filed: May 21, 2018

(65) Prior Publication Data

US 2018/0333753 A1 Nov. 22, 2018

Related U.S. Application Data

(60) Provisional application No. 62/509,274, filed on May 22, 2017.

(51) Int. Cl.

| | |
|---|---|
| ***B08B 1/04*** | (2006.01) |
| ***A47L 11/24*** | (2006.01) |
| ***B08B 1/00*** | (2006.01) |
| ***A47L 11/40*** | (2006.01) |
| ***E01H 1/05*** | (2006.01) |
| *E01H 1/04* | (2006.01) |

(52) U.S. Cl.

CPC ..... *B08B 1/04* (2013.01); *A47L 11/24* (2013.01); *A47L 11/4041* (2013.01); *A47L 11/4072* (2013.01); *A47L 11/4075* (2013.01); *B08B 1/002* (2013.01); *E01H 1/056* (2013.01); *E01H 1/042* (2013.01); *E01H 1/045* (2013.01)

(58) Field of Classification Search

CPC . B08B 1/04; B08B 1/002; A47L 11/24; A47L 11/4041; A47L 11/4072; E01H 1/042; E01H 1/045; E01H 1/056; E01H 1/04; A01G 1/125; B25F 5/00; B25F 5/02

USPC ..... 15/79.2, 22.1, 176.3; 33/203; 173/184; 172/1

See application file for complete search history.

(56) References Cited

U.S. PATENT DOCUMENTS 4,286,675 A * 9/1981 Tuggle ..... A01G 3/053 173/213
4,602,400 A * 7/1986 Agergard ..... E01H 1/056 15/79.2
5,407,012 A 4/1995 Klöpfer
(Continued)

FOREIGN PATENT DOCUMENTS

EP 1 710 024 A2 10/2006
EP 1 567 723 B1 8/2007
(Continued)

*Primary Examiner* — Katina N. Henson
(74) *Attorney, Agent, or Firm* — Michael Best & Friedrich LLP

(57) ABSTRACT

A power sweeper has a handle having a first end graspable by a user and a second end, a drive shaft extending along the handle, and a power head coupled to the handle to rotate the drive shaft. A gear box is coupled to the drive shaft adjacent the second end, and a brush is coupled to the gear box for rotation in response to rotation of the drive shaft. The power sweeper includes an axle, and first and second wheels coupled to the axle. A shield is coupled to the gear box and defines an aperture through which the handle extends. The axle is moveable with respect to the shield and the brush to adjust an angle between the handle and the ground surface.

17 Claims, 7 Drawing Sheets

(56) References Cited

U.S. PATENT DOCUMENTS

| | | | | |
|---|---|---|---|---|
| 6,688,404 | B2 | 2/2004 | Uhl et al. | |
| 7,080,851 | B2 | 7/2006 | Schipper | |
| 7,373,685 | B2 | 5/2008 | Nam | |
| 7,631,388 | B2 | 12/2009 | Stark et al. | |
| 7,891,036 | B2 | 2/2011 | Hahn et al. | |
| 8,006,341 | B2 | 8/2011 | Merz et al. | |
| 8,677,543 | B2 | 3/2014 | Wilkins | |
| 9,027,189 | B2 | 5/2015 | Hickenbottom et al. | |
| 9,585,534 | B2 | 3/2017 | Reccanello | |
| 2005/0045347 | A1 | 3/2005 | Stark et al. | |
| 2006/0124324 | A1 | 6/2006 | Neusink et al. | |
| 2013/0212815 | A1* | 8/2013 | Kempf | E01H 1/105 15/22.1 |
| 2015/0034391 | A1* | 2/2015 | McLain | A46B 13/02 175/162 |

FOREIGN PATENT DOCUMENTS

| | | | |
|---|---|---|---|
| EP | 2 932 877 | A1 | 10/2015 |
| WO | 99/07202 | | 2/1999 |
| WO | 2004/051001 | A1 | 6/2004 |
| WO | 2010/079126 | A1 | 7/2010 |

* cited by examiner

POWER SWEEPER

CROSS-REFERENCE TO RELATED APPLICATIONS

The present application claims priority to U.S. Provisional Application No. 62/509,274 filed May 22, 2017, the contents of which are herein incorporated by reference.

BACKGROUND

The present invention relates to power sweepers.

SUMMARY

Some embodiments of the invention include a power sweeper having a handle with a first end graspable by a user and a second end, a drive shaft extending along the handle, and a power head coupled to the handle to rotate the drive shaft. A gear box is coupled to the drive shaft adjacent the second end and a brush is coupled to the gear box for rotation in response to rotation of the drive shaft. The power sweeper includes an axle, a first wheel coupled to the axle, the first wheel being configured to roll along a ground surface, and a second wheel coupled to the axle, the second wheel being configured to roll along the ground surface. A shield is coupled to the gear box and defines an aperture through which the handle extends. The axle is moveable with respect to the shield and the brush to adjust an angle between the handle and the ground surface.

Some embodiments of the invention include a method of adjusting an angle of a handle of a power sweeper with respect to a support surface. The method includes coupling a pair of wheels to an axle, coupling a support member to the axle, coupling a handle to the support member, extending a drive shaft through the handle, coupling a power head to a first end of the drive shaft, coupling a brush to a second end of the drive shaft, rotating the brush with the drive shaft in response operation of the power head, and moving the support member with respect to the axle to change an angle between the handle and the support surface.

Some embodiments of the invention include a power sweeper configured to be coupled to a power head. The power sweeper includes a handle graspable by a user, a wheel coupled to the handle, and a brush coupled to at least one of the handle and the wheel. A drive shaft is coupled to the brush to rotate the brush. The drive shaft is configured to be rotated by the power head. A shield is coupled to the wheel and defines an aperture through which the handle extends. The shield is moveable with respect to the wheel to adjust an angle between the handle and a ground surface.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
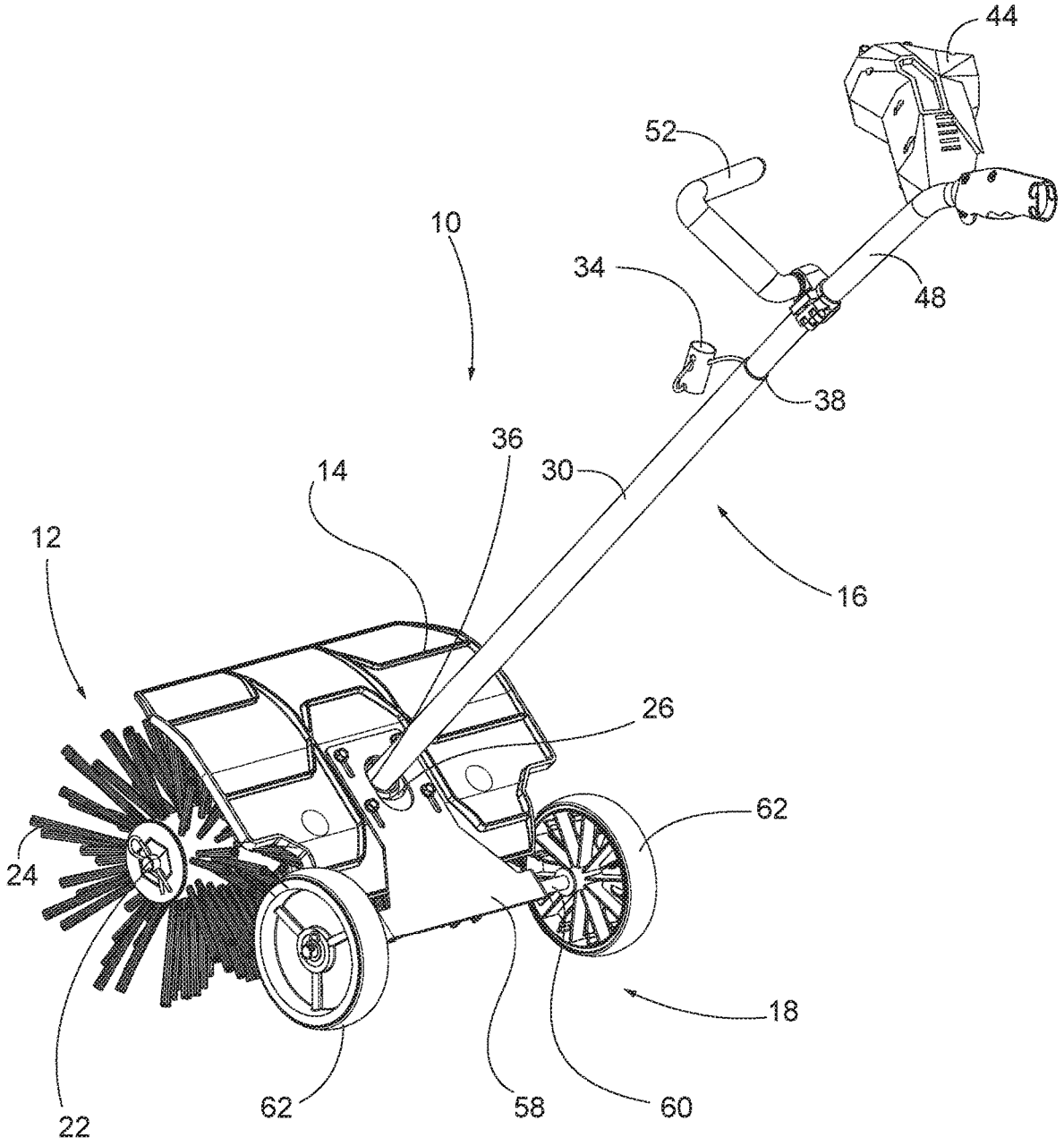
FIG. 1 is a perspective view of a power sweeper according to an embodiment of the invention.

FIG. 1 illustrates a power sweeper 10. The power sweeper 10 includes a sweeping assembly 12, a shield 14, a handle assembly 16, and a wheel assembly 18.

Figure 2:
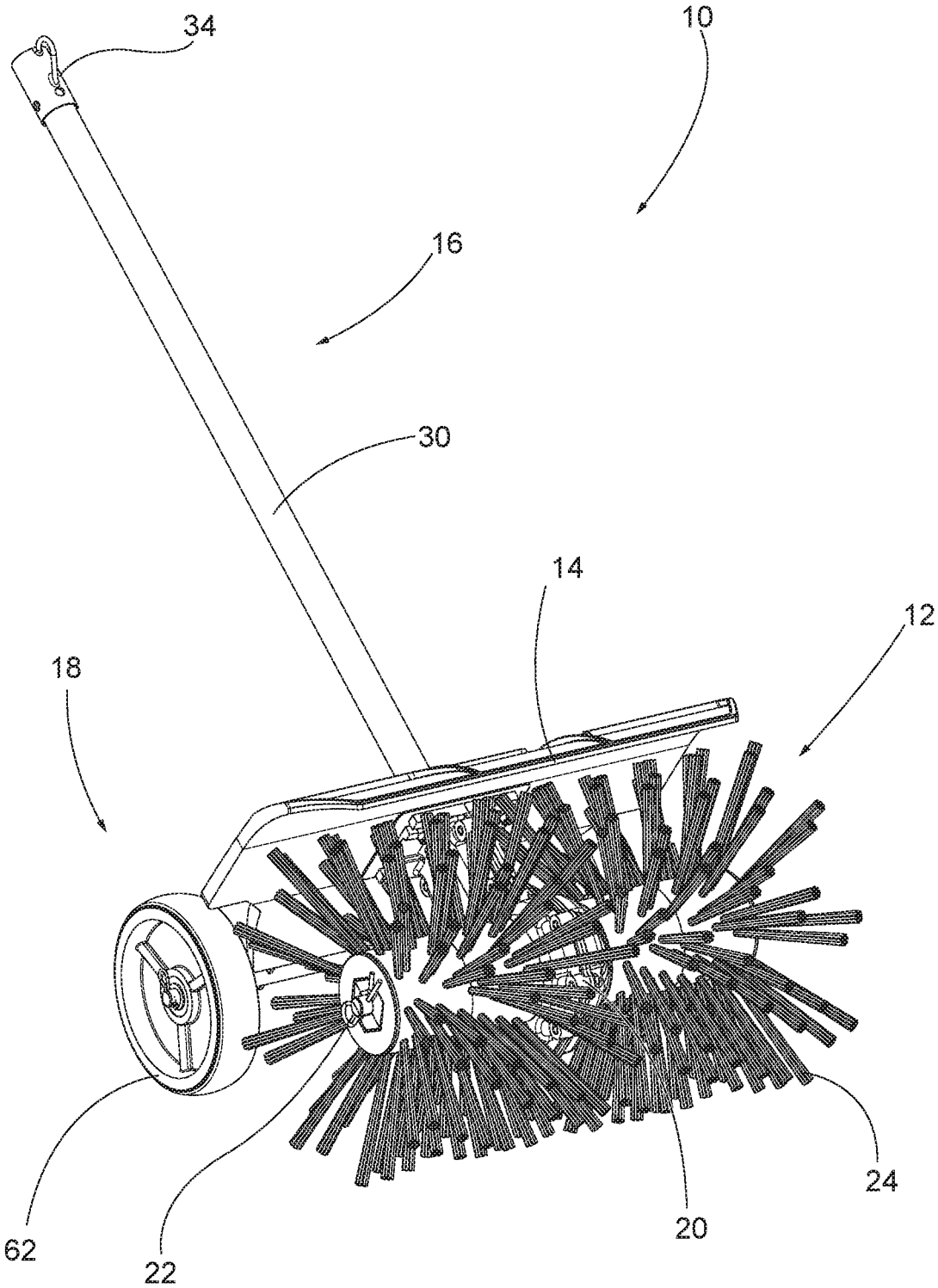
FIG. 2 is an alternative perspective view of the power sweeper of FIG. 1.

As shown in FIGS. 1 and 2, the illustrated sweeping assembly 12 includes a gearbox 20, and a driven shaft 22, and a brush 24. The driven shaft 22 is coupled to the gearbox 20 such that the gearbox 20 rotates the driven shaft 22. In one embodiment, the gearbox 20 includes a tiller gearbox. The brush 24 is coupled to the driven shaft 22 for rotation with the driven shaft 22 by the gearbox 20. In the illustrated embodiment, the brush 24 includes nylon bristles. In other embodiments, other suitable types of brushes, which may or may not include bristles, can be utilized. For example, the brush could include a plurality of rubber blades.

Figure 5:
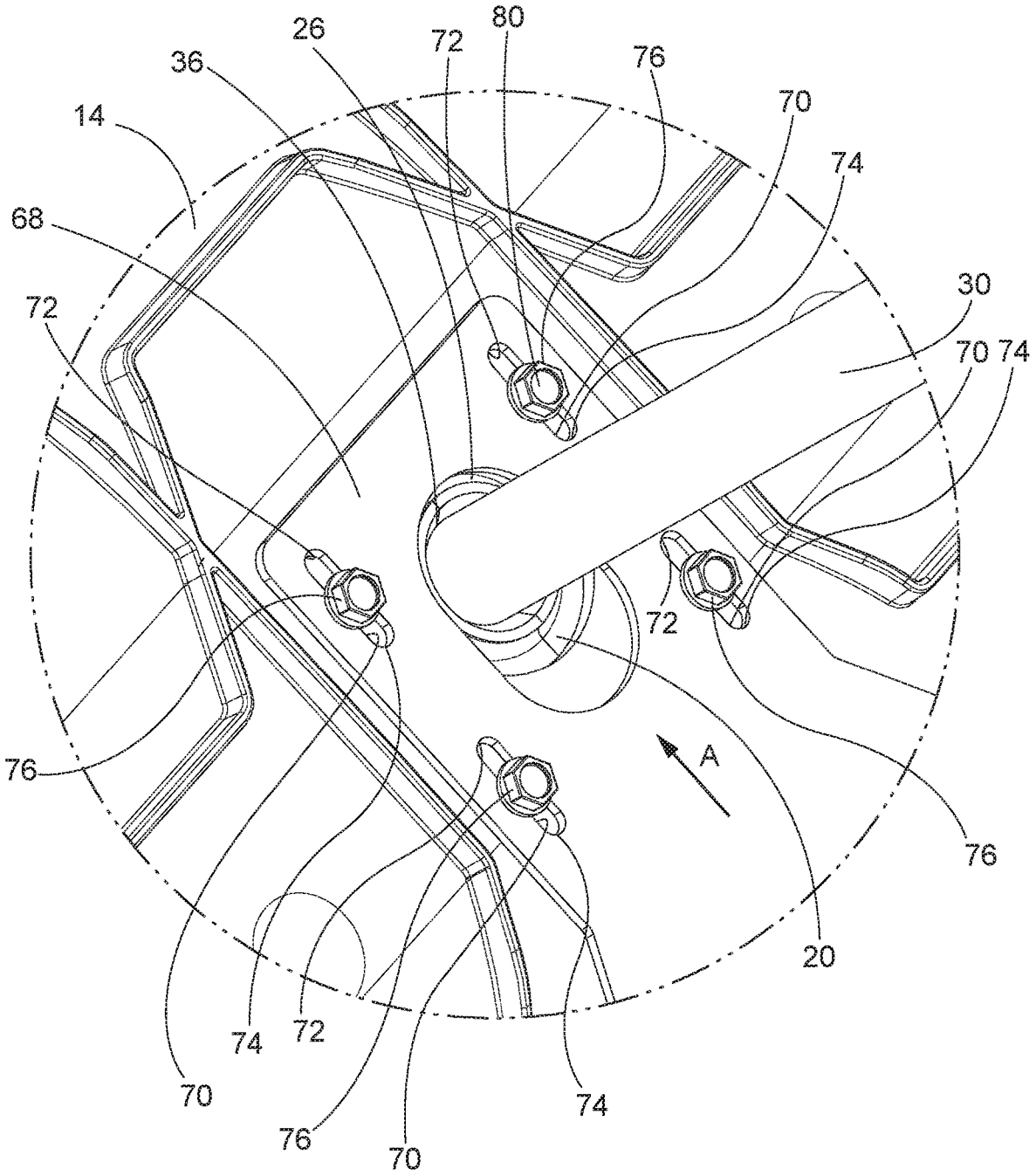
FIG. 5 is an enlarged view of a portion of the power sweeper of FIG. 1.

The shield 14 is coupled to the gearbox 20 such that the shield is fixed from movement relative to the gearbox 20. As best seen in FIG. 5, the shield 14 includes an aperture 26. The gearbox 20 extends into the aperture 26 to facilitate properly aligning and locating the position of the gearbox 20 relative to the shield 14 during assembly of the sweeper 10. The illustrated shield 14 is generally arcuate and the shield curves around a portion of the brush 24. In one embodiment the shield 14 is made from polypropylene. The shield 14 inhibits debris pushed by the brush 24 from going back toward the user.

Figure 3:
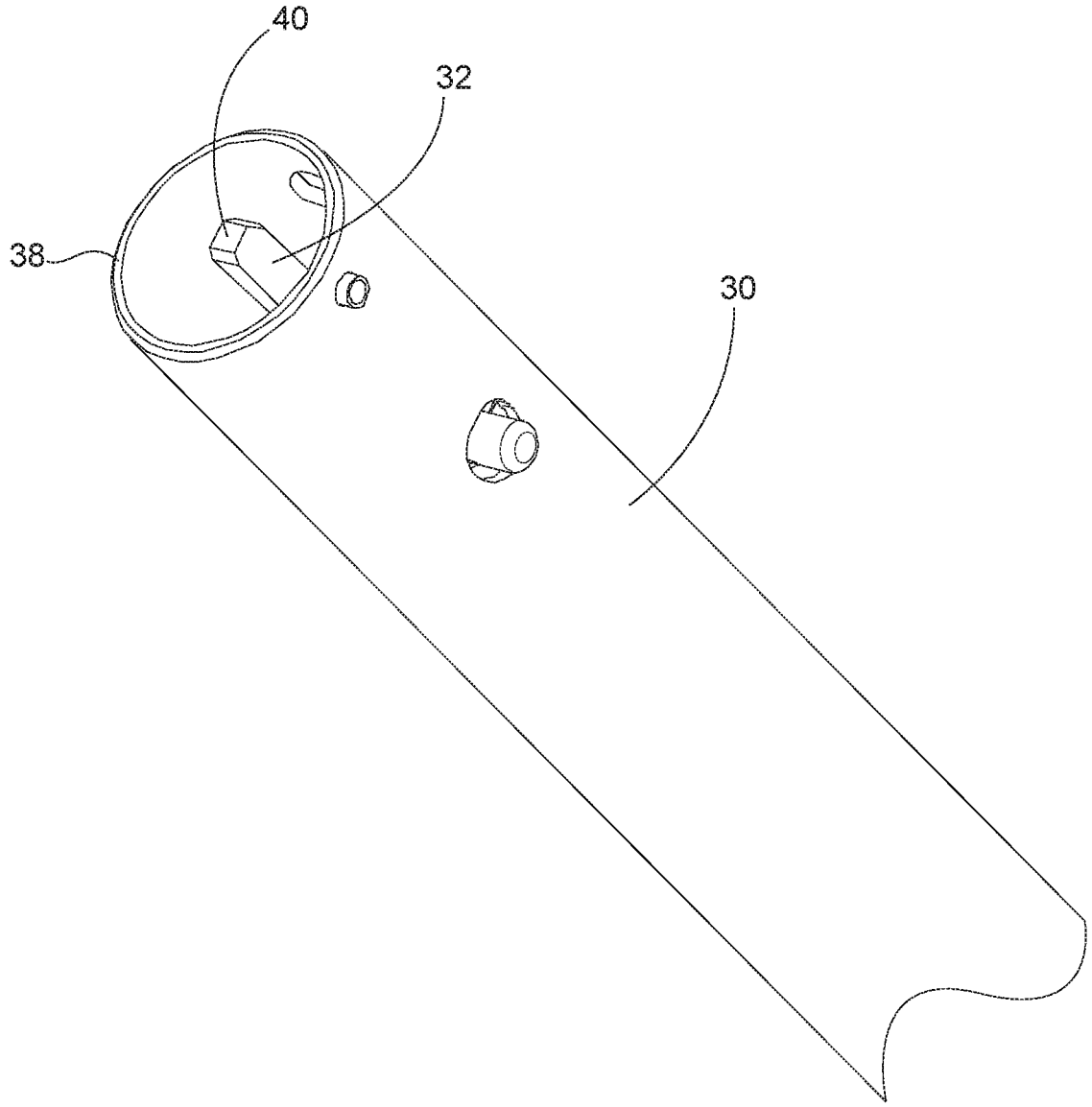
FIG. 3 is an enlarged view of a handle of the power sweeper of FIG. 1 with a cap removed.
Figure 4:
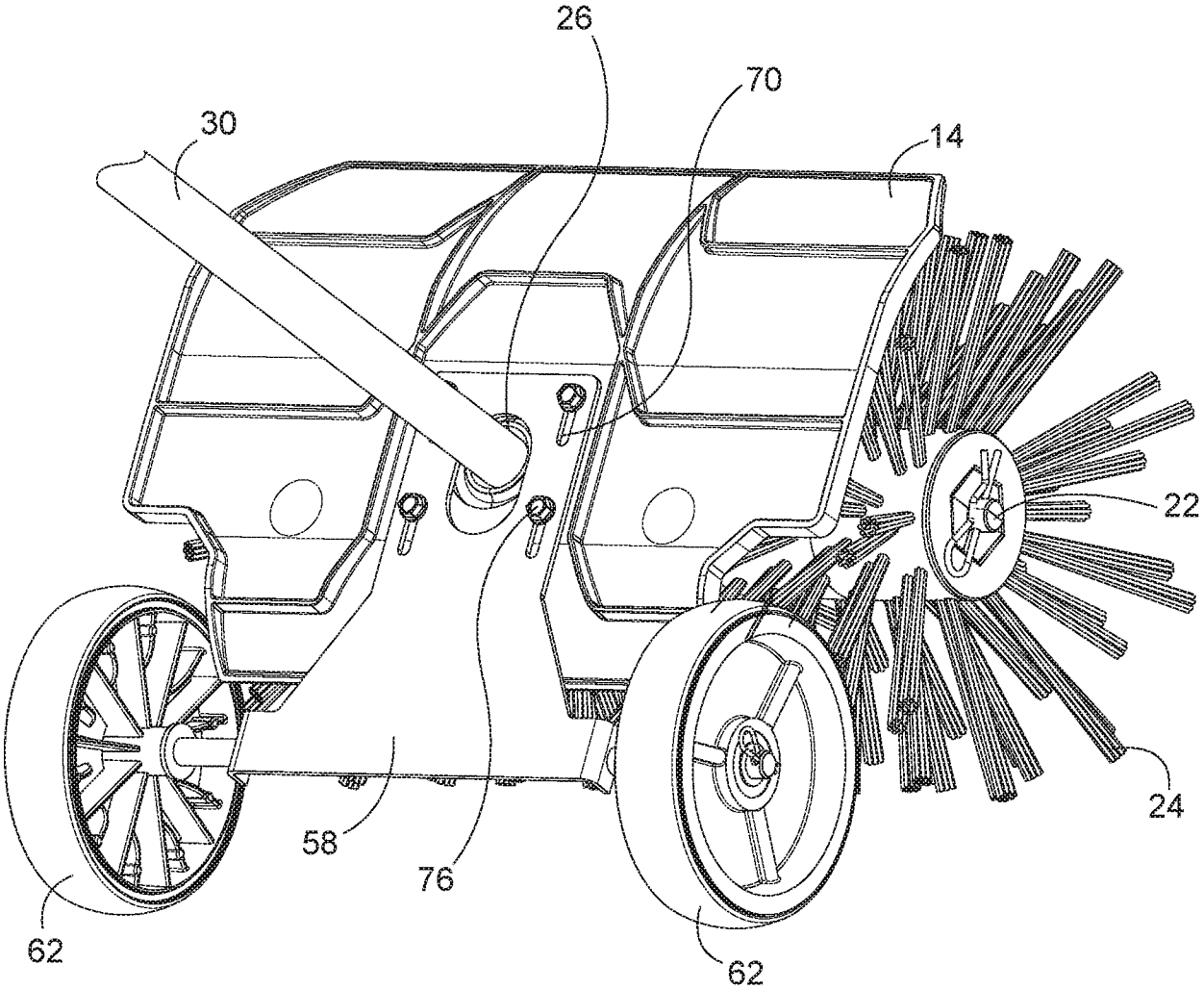
FIG. 4 is an enlarged view of a portion of the power sweeper of FIG. 1.

Referring to FIGS. 2 and 3, the handle assembly 16 includes a handle 30, a drive shaft 32 inside the handle, and a cap 34. The handle 30 is hollow and includes a first end 36 and a second end 38. The first end 36 (FIG. 5) of the handle 30 is adjacent the gearbox 20. The handle 30 is generally fixed to the gearbox 20. The second end 38 of the handle 30 includes the cap 34. The cap 34 is removable to access the drive shaft 32. The drive shaft 32 includes a first end that is received in the gearbox 20 and a second end 40 (FIG. 3) adjacent the second end 38 of the handle 30. The second end 40 of the drive shaft 32 is accessible when the cap 34 is removed.

As shown in FIG. 1, the second end 38 of the handle 30 and the second end 40 of the drive shaft 32 can be connected to a power head 44 to rotate the drive shaft 32 relative to the handle 30. The power head 44 can include a two-cycle gas engine, a battery powered electric motor, or an A-C electric motor. The illustrated power head 44 is coupled to the second end 38 of the handle 30 via an elongate shaft 48. A gripping portion 52 is also coupled to the elongate shaft 48 in the illustrated embodiment. In the illustrated embodiment, the gripping portion 52 is removably coupled to the elongate shaft 48 such that other sizes and shapes of gripping portions can be utilized in place of the illustrated gripping portion 52. In one embodiment, the power head 44 is part of kit that includes additional tools for use with the power head such as a string trimmer, edger, blower, shrub trimmer and the like. Rotation of the drive shaft 32 by the power head 44 rotates the driven shaft 22 of the sweeping assembly 12 via the gearbox 20. In the illustrated embodiment, the handle 30 and the drive shaft 32 are straight but in other embodiments the handle and drive shaft can be curved.

Figure 6:
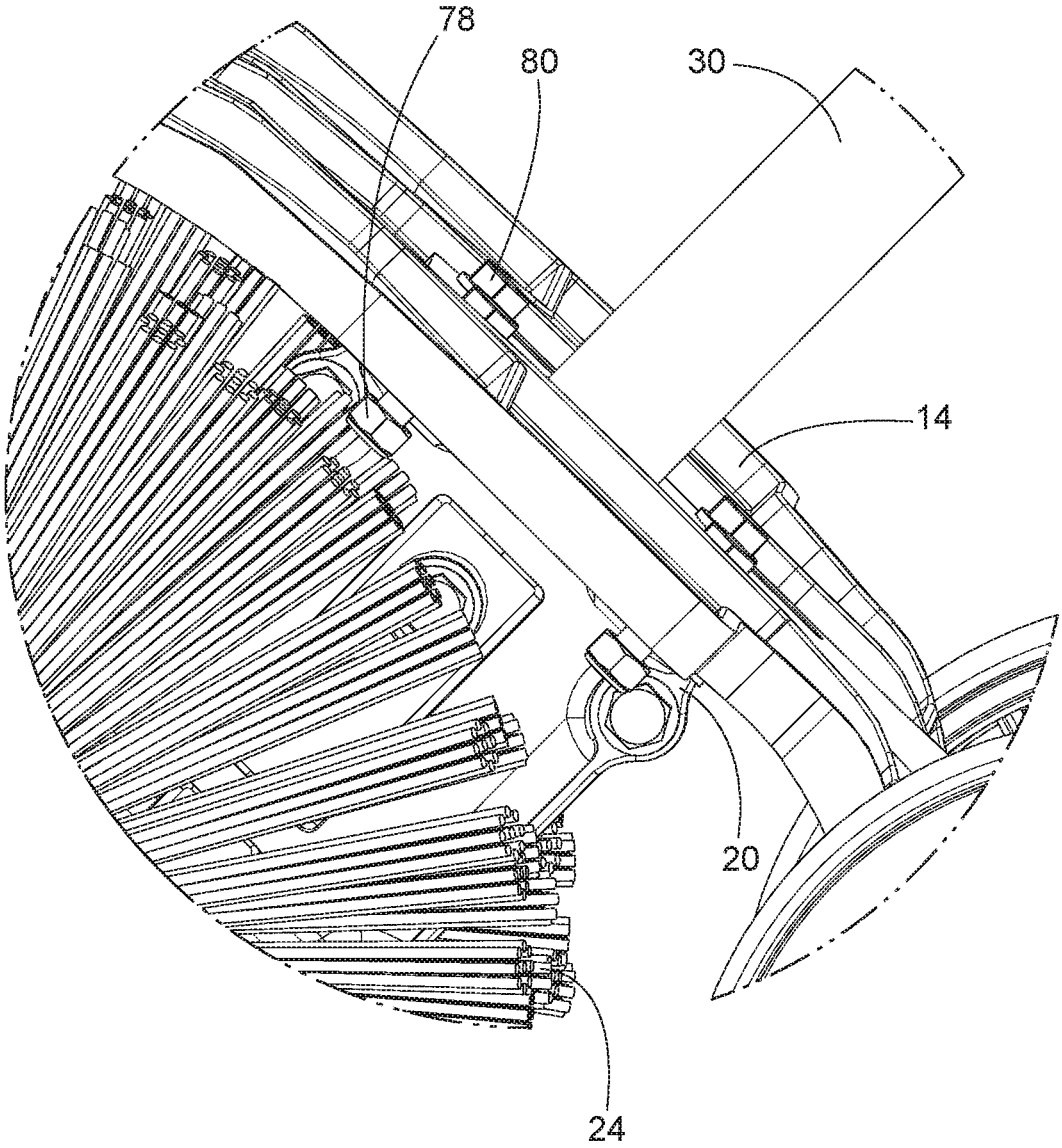
FIG. 6 is an enlarged side view of a portion of the power sweeper of FIG. 1.

Referring to FIGS. 1 and 5, the wheel assembly 18 includes a bracket 58, an axle 60, and wheels 62. The axle 60 extends through the bracket 58 and couples the wheels 62 to the bracket 58. In the illustrated embodiment, each wheel 62 is removably coupled to the axle 60 using a washer and a cotter pin. The bracket 58 includes a flange 68 and elongated recesses 70 (FIG. 5) that extend through the flange 68. Each recess 70 has a first end 72 and a second end 74. The bracket 58 and wheel assembly 18 are coupled to the shield 14 and sweeping assembly 12 using fasteners 76 that extend through the recesses 70. Referring to FIG. 6, the illustrated fasteners 76 include a nut 78 and a bolt 80. In other embodiments, other types of fasters can be used, such as a bolt and wing nut, quick release type fasteners, knobs and bolts, and the like.

In operation, the user uses the power head 44 to rotate the drive shaft 32. Rotation of the drive shaft 32 rotates the brush 24 and the sweeper 10 is used for sweeping a surface 82 (FIG. 7), such as a driveway, sidewalk, lawn, and the like. The wheels 62 and handle 30 facilitate easy movement of the sweeper 10 along the surface 82 being swept. Also, the wheels 62 and axle 60 provide a pivot point about which the user can rotate the brush 24 using the handle 30. The user can push down on the handle 30, which raises the brush 24 from the surface 82. The user can lift the handle 30, which increases the pressure applied by the brush 24 on the surface 82.

Figure 7:
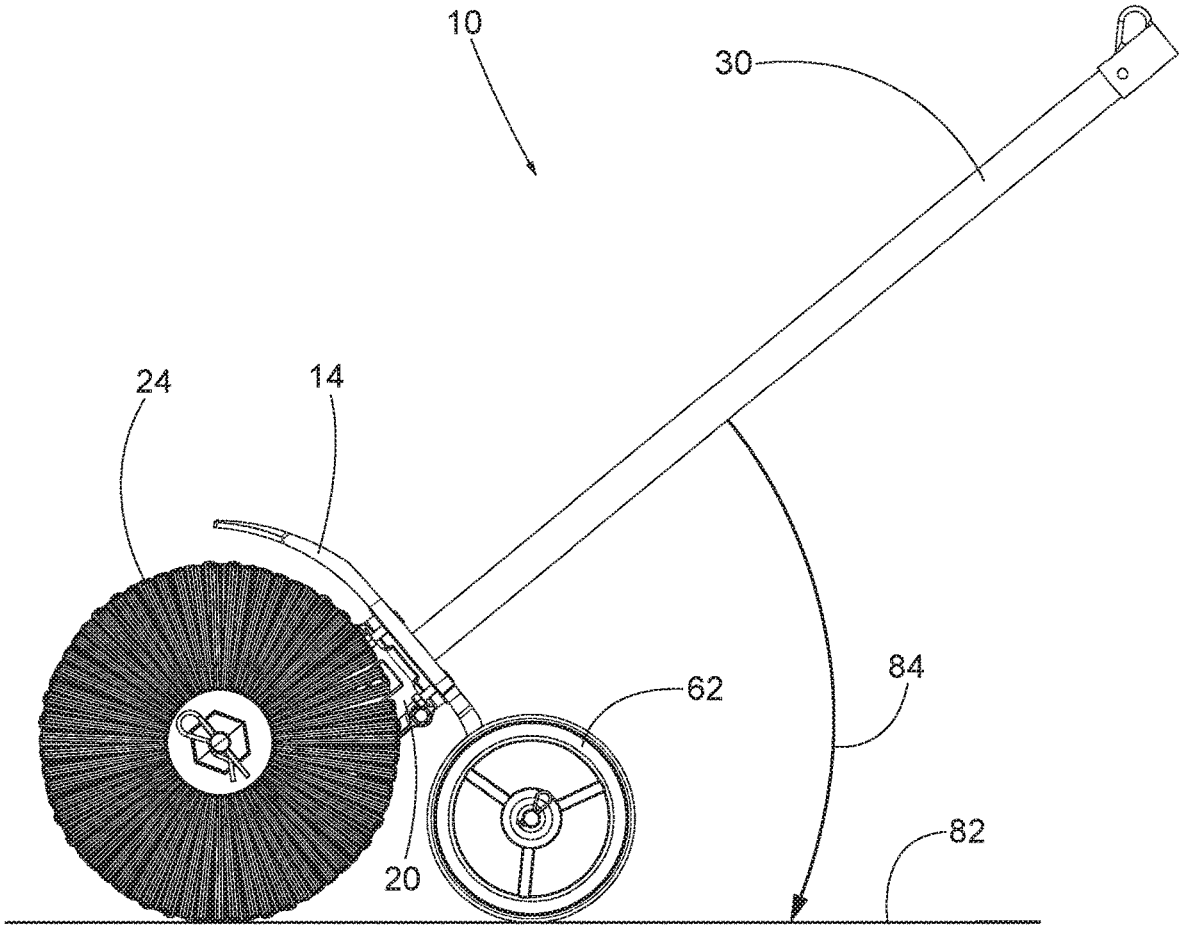
FIG. 7 is a side view of the power sweeper of FIG. 1 illustrating the handle in a first position.

With continued reference to FIG. 7, the user can also adjust the angle 84 between the handle 30 and the surface 82 using the fasteners 76. By loosening the fasteners 76 (see FIG. 5) the user can slide the flange 68 relative to the shield 14 in the direction of arrow A to adjust the angle 84 and then re-tighten the fasteners 76. If the bolts 80 are positioned at the first ends 72 of the recesses 70, the angle 84 is maximized. If the bolts 80 are positioned at the second ends 74 of the recesses 70, the angle 84 is minimized. In one embodiment, the angle 84 can be adjusted anywhere in a range from 35 degrees to 40 degrees. In another embodiment, the angle 84 can be adjusted anywhere in a range from 30 degrees to 45 degrees. Adjustment of the angle 84 allows the user to position the handle 30 for maximum conform and performance based on conditions such as the user's height and surface being swept.

What is claimed is:

1. A power sweeper comprising:

a handle having a first end and a second end graspable by a user;

a drive shalt extending along the handle;

a power head coupled to the handle to rotate the drive shaft;

a gear box coupled to the drive shalt adjacent the first end;

a brush coupled to the gear box for rotation in response to rotation of the drive shaft;

an axle;

a first wheel coupled the axle, the first wheel configured to roll along a ground surface;

a second wheel coupled to the axle, the second wheel configured to roll along the ground surface;

a shield coupled to the gear box, the shield defining an aperture through which the handle extends; and a bracket coupled to the axle and the bracket coupled to the shield, wherein the axle is moveable with respect to the shield and the brush to adjust an angle between the handle and the ground surface, and wherein the bracket slides along the shield to move the first wheel, the second wheel, and the axle relative to the shield to adjust the angle between the handle and the ground surface.

2. The power sweeper of claim 1, wherein the brush defines a circumference and wherein the shield extends around a portion of the circumference of the brush.

3. The power sweeper of claim 1, wherein the drive shaft extends along an entire length of the handle between the handle first end and the handle second end.

4. The power sweeper of claim 1, further comprising a cap coupled to the second end of the handle, the cap being removable from the second end of the handle to uncover the drive shaft, and wherein the power head is removably coupled to the second end of the handle.

5. The power sweeper of claim 1, further comprising a bracket coupled to the axle, wherein the shield defines a first aperture and the bracket defines a second aperture, and further comprising a fastener extending through the first aperture and the second aperture to couple the bracket to the shield.

6. The power sweeper of claim 5, wherein the second aperture is an elongate slot such that the shield can be coupled to the bracket at a plurality of locations to permit adjustment of the angle between the handle and the ground surface.

7. A method of adjusting an angle of a handle of a power sweeper with respect to a support surface, the method comprising:

coupling a pair of wheels to an axle;

coupling a support member to the axle;

coupling a shield to the support member;

coupling a handle to the support member;

extending a drive shaft through the handle;

coupling a power head to a first end of the drive shaft;

coupling a brush to a second end of the drive shaft;

rotating the brush with the drive shaft in response to operation of the power head; and moving the support member with respect to the shield to move the pair of wheels and the axle relative to the shield to change an angle between the handle and the support surface.

8. The method of claim 7, wherein the shield is coupled to the support member by inserting a fastener through a first aperture in the shield and through a second aperture in the support member.

9. The method of claim 7, further comprising fixing the support member to the axle, wherein moving the shield with respect to the axle includes moving the shield with respect to the support member.

10. The method of claim 9, further comprising loosening the fastener prior to moving the shield with respect to the support member, and tightening the fastener after moving the shield with respect to the support member.

11. The method of claim 8, further comprising coupling the shield to a gearbox such that the shield extends around a portion of the brush.

12. A power sweeper configured to be coupled to a power head, the power sweeper comprising:

a handle graspable by a user;

a first wheel and a second wheel coupled to the handle;

an axle extending between the first wheel and the second wheel;

a brush coupled to at least one of the handle, the first wheel and the second wheel;

a drive shaft coupled to the brush to rotate the brush, the drive shaft configured to be rotated by the power head;

a shield coupled to the wheel, the shield defining an aperture through which the handle extends; and a bracket coupled to the axle and coupled to the shield, wherein the shield is moveable with respect to the wheel to adjust an angle between the handle and a ground surface, and wherein the bracket slides along the shield to move the first wheel, the second wheel, and the axle relative to the shield to adjust the angle between the handle and the ground surface.

13. The power sweeper of claim 12, further comprising a gear box coupled to the drive shaft and the brush, wherein the shield is coupled to the gear box and the shield extends around a portion of a circumference of the brush.

14. The power sweeper of claim 12, wherein a first end of the handle is coupled to the wheel and a second end of the handle is spaced from the wheel, wherein the drive shaft extends along substantially an entire length of the handle between the handle first end and the handle second end.

15. The power sweeper of claim 12, wherein the shield defines a first aperture and the bracket defines a second aperture, and further comprising a fastener extending through the first aperture and the second aperture to couple the bracket to the shield.

16. The power sweeper of claim 14, further comprising a cap coupled to the second end of the handle, the cap being removable from the second end of the handle to uncover the drive shaft, and wherein the power head is removably coupled to the second end of the handle.

17. The power sweeper of claim 15, wherein the second aperture is an elongate slot such that the shield can be coupled to the bracket at a plurality of locations to permit adjustment of the angle between the handle and the support surface.

* * * * *